US010261459B2

(12) United States Patent
Katahira et al.

(10) Patent No.: US 10,261,459 B2
(45) Date of Patent: Apr. 16, 2019

(54) IMAGE FORMING APPARATUS WITH ACCUMULATED TONER AMOUNT CALCULATOR

(71) Applicant: FUJI XEROX CO., LTD., Tokyo (JP)

(72) Inventors: Masahiro Katahira, Kanagawa (JP); Yoshinori Takahashi, Kanagawa (JP); Yasuto Okabayashi, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/609,288

(22) Filed: May 31, 2017

(65) Prior Publication Data

US 2018/0143575 A1 May 24, 2018

(30) Foreign Application Priority Data

Nov. 18, 2016 (JP) ..... 2016-224623

(51) Int. Cl.

| | |
|---|---|
| ***G03G 21/12*** | (2006.01) |
| ***G03G 15/00*** | (2006.01) |
| ***G03G 15/14*** | (2006.01) |
| ***G03G 21/10*** | (2006.01) |

(52) U.S. Cl.

CPC ..... *G03G 15/556* (2013.01); *G03G 15/14* (2013.01); *G03G 21/10* (2013.01)

(58) Field of Classification Search

CPC ..... G03G 15/14; G03G 15/556; G03G 21/10
See application file for complete search history.

(56) References Cited

U.S. PATENT DOCUMENTS

| | | | | |
|---|---|---|---|---|
| 2009/0136247 | A1* | 5/2009 | Nada | G03G 15/043 399/45 |
| 2009/0202279 | A1* | 8/2009 | Saito | G03G 15/5095 399/297 |
| 2009/0324278 | A1* | 12/2009 | Tomura | G03G 15/161 399/101 |
| 2013/0028625 | A1* | 1/2013 | Ando | G03G 15/0189 399/72 |
| 2014/0023388 | A1* | 1/2014 | Yoshida | G03G 15/14 399/66 |
| 2018/0136592 | A1* | 5/2018 | Takahashi | G03G 15/1615 |

FOREIGN PATENT DOCUMENTS

| | | |
|---|---|---|
| JP | 2004-163885 A | 6/2004 |
| JP | 2007-003611 A | 1/2007 |
| JP | 2007-298623 A | 11/2007 |

* cited by examiner

*Primary Examiner* — Francis C Gray
(74) *Attorney, Agent, or Firm* — Sughrue Mion, PLLC

(57) ABSTRACT

An image forming apparatus includes a transfer unit, a container, and a calculator. The transfer unit transfers to at least one recording medium at least one toner image formed in accordance with image data without margins set along edges of the at least one recording medium. The container contains toner collected from the transfer unit. The calculator calculates an amount of the toner of parts of the at least one toner image outside the edges of the at least one recording medium. A time period during which the container is able to be used is calculated in accordance with an accumulated amount of the toner calculated by the calculator.

13 Claims, 12 Drawing Sheets

IMAGE FORMING APPARATUS WITH ACCUMULATED TONER AMOUNT CALCULATOR

CROSS-REFERENCE TO RELATED APPLICATIONS

This application is based on and claims priority under 35 USC 119 from Japanese Patent Application No. 2016-224623 filed Nov. 18, 2016.

BACKGROUND

Technical Field

The present invention relates to an image forming apparatus.

SUMMARY

According to an aspect of the present invention, an image forming apparatus includes a transfer unit, a container, and a calculator. The transfer unit transfers to at least one recording medium at least one toner image formed in accordance with image data without margins set along edges of the at least one recording medium. The container contains toner collected from the transfer unit. The calculator calculates an amount of the toner of parts of the at least one toner image outside the edges of the at least one recording medium. A time period during which the container is able to be used is calculated in accordance with an accumulated amount of the toner calculated by the calculator.

BRIEF DESCRIPTION OF THE DRAWINGS

Exemplary embodiments of the present invention will be described in detail based on the following figures, wherein.

DETAILED DESCRIPTION

Figure 1:
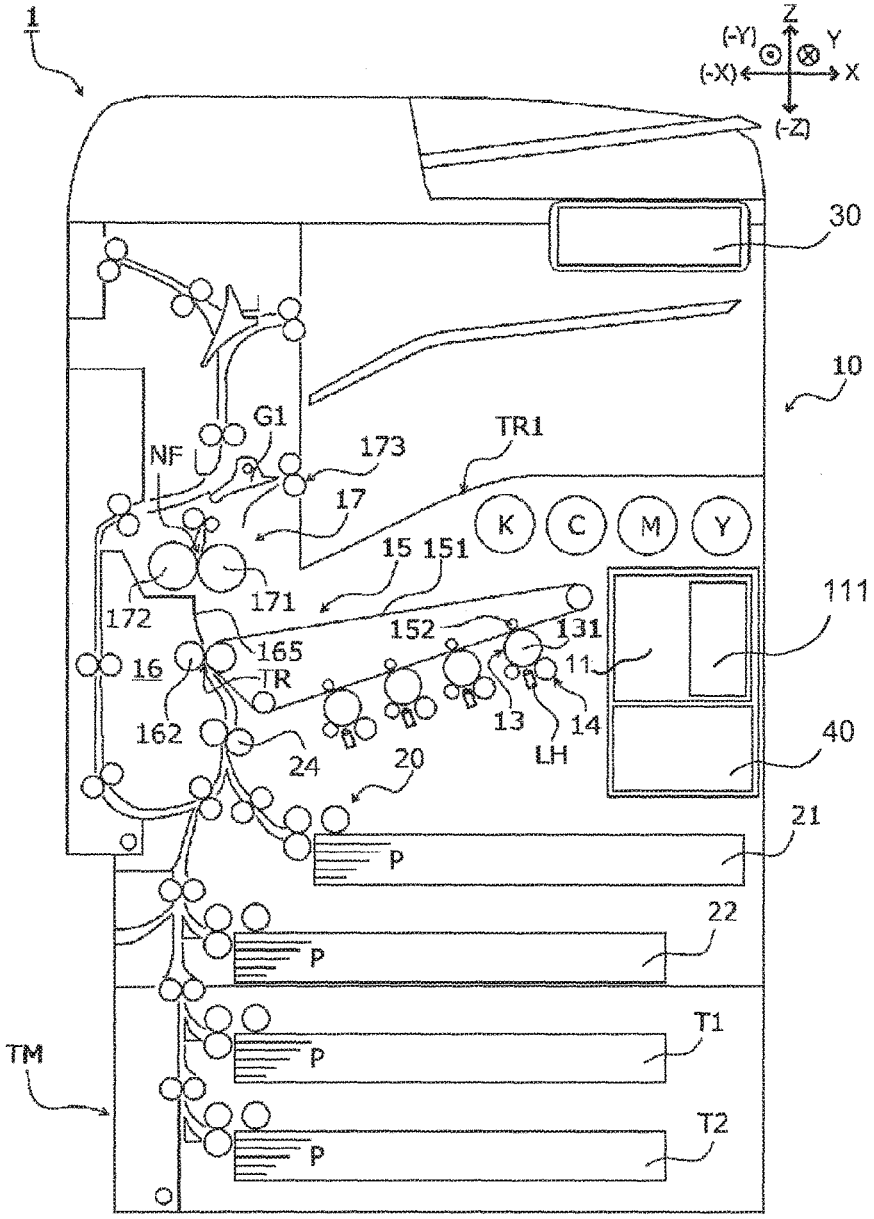
FIG. 1 is a schematic sectional view of an internal structure of an image forming apparatus.

Next, although exemplary embodiments and specific examples of the present invention will be described in further detail below with reference to the drawings, it should be understood that the present invention is not limited to the exemplary embodiments and the specific examples.

Furthermore, it should be noted that the drawings referred to in the following description are schematically illustrated and, for example, ratios between the dimensions of elements are different from actual ratios, and illustration of elements not required for the description is omitted as appropriate for ease of understanding.

Also for ease of understanding in the following description, the front-rear direction is represented as the X direction, the left-right direction is represented as the Y direction, and the up-down direction is represented as the Z direction in the drawings.

First Exemplary Embodiment (1) An Overall Structure and Operation of an Image Forming Apparatus FIG. 1 is a schematic sectional view of an internal structure of an image forming apparatus 1 according to a first exemplary embodiment.

An overall structure and operation of the image forming apparatus 1 is described below with reference to the drawings.

(1.1) The Overall Structure of an Image Forming Apparatus

The image forming apparatus 1 includes an image forming section 10, a sheet feed device 20 attached at a bottom portion of the image forming section 10, an operating display 30, and an image processing unit 40.

The image forming section 10 includes a system controller 11, light exposure devices 12, photosensitive units 13, developing devices 14, a transfer device 15, a sheet transport device 16, and a fixing device 17. The image forming section 10 receives image information from the image processing unit 40 and forms toner images of the image information on sheets of paper P fed from the sheet feed device 20.

The sheet feed device 20 that includes sheet trays 21 and 22 is provided at the bottom portion of the image forming section 10 so as to feed the sheets P to the image forming section 10. Furthermore, a tray module TM is connected to a lower portion of the sheet feed device 20 so as to feed the sheets P to the image forming section 10. The tray module TM includes sheet trays T1 and T2 that are vertically stacked to form a multi-tray structure (two trays according to the present exemplary embodiment) and that contain the sheets P.

That is, plural trays that contain different types (for example, material, thickness, sheet size, and paper grain) of the sheets P are provided, and each of the sheets P fed from a corresponding one of these plural trays is supplied to the image forming section 10.

The operating display 30 corresponds to a so-called user interface. Specifically, the operating display 30 includes a liquid crystal display panel, various operating buttons, a touch panel, and so forth combined with one another, so that the operating display 30 is used to input various settings and instructions and display information.

Figure 2:
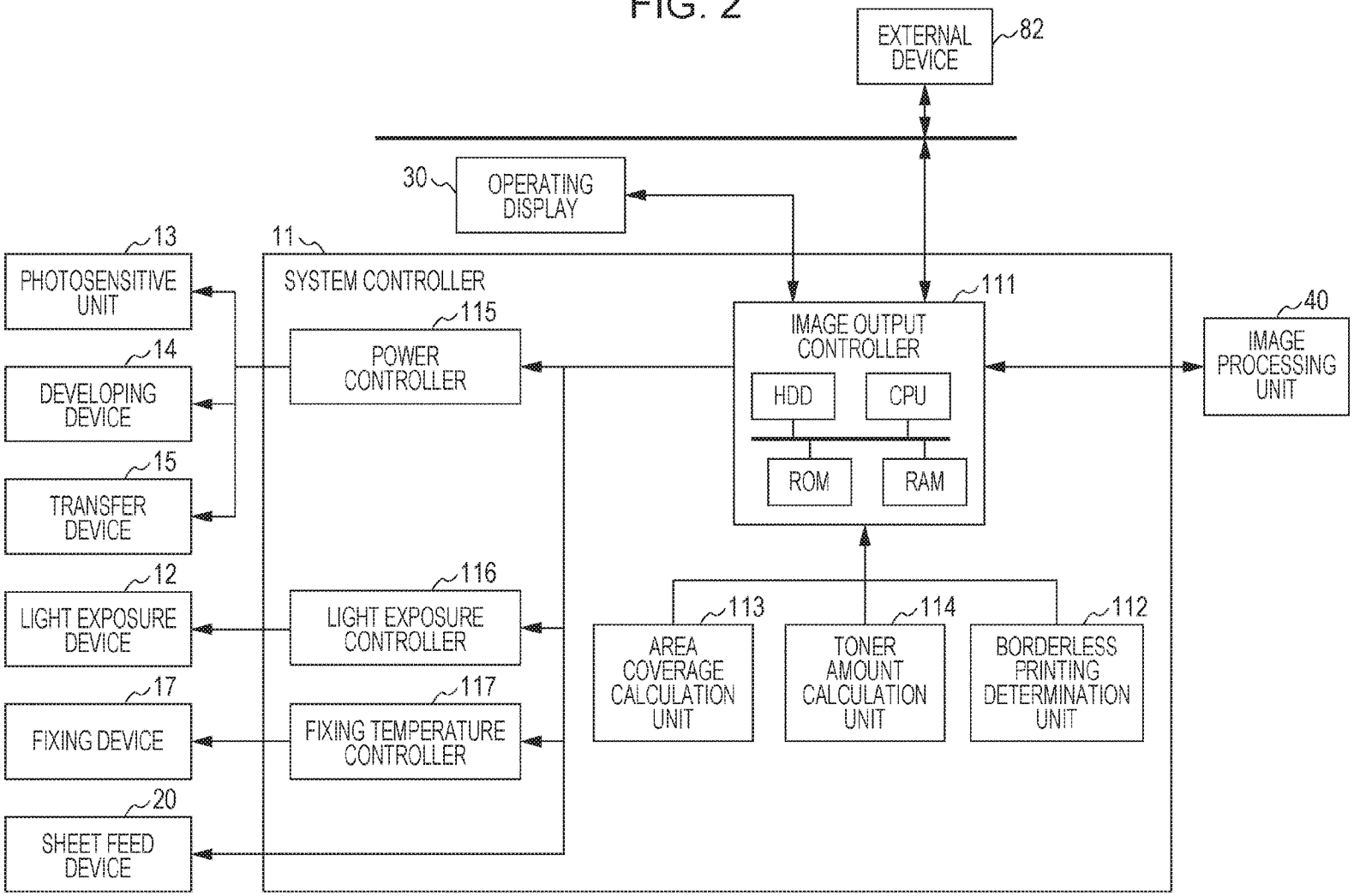
FIG. 2 is a block diagram illustrating an example of a functional configuration of the image forming apparatus.

The image processing unit 40 generates image data from print information transmitted from an external device 82 (illustrated in FIG. 2, for example, personal computer or the like).

(1.2) A Structure and Operation of the Image Forming Section 10

In the image forming apparatus 1 having such a structure, the sheets P are fed from the trays of the sheet feed device 20 or the tray module TM to the image forming section 10 at timing adjusted to timing of image formation. The trays of these sheets P are specified by print jobs on a sheet-by-sheet basis for printing.

The photosensitive units 13 are arranged in parallel to one another above (Z direction) the sheet feed device 20. The photosensitive units 13 include respective photosensitive drums 131 that are rotated. Electrostatic latent images are formed on the photosensitive drums 131 by the respective light exposure devices 12. Toner image components of yellow (Y), magenta (M), cyan (C), and black (K) are formed by the respective developing devices 14 on the photosensitive drums 131 bearing these electrostatic latent images.

The transfer device 15 includes an intermediate transfer belt 151 and first transfer rollers 152. The toner image components of the colors formed on the photosensitive drums 131 of the photosensitive units 13 are transferred onto the intermediate transfer belt 151 so as to be superposed on one another. The first transfer rollers 152 sequentially transfer (first transfer) the toner image components of the colors formed by the photosensitive units 13 onto the intermediate transfer belt 151.

The sheet transport device 16 includes a driven roller 24*b* of a registration roller pair 24 and a second transfer roller 162. The driven roller 24*b* corrects the orientation of each of the sheets P fed from the sheet feed device 20 and feeds the sheet P to a second transfer portion TR at timing adjusted to timing of second transfer. The second transfer roller 162 collectively transfers (second transfer) onto the sheet P serving as a recording medium the toner image components of the colors having been transferred onto the intermediate transfer belt 151 so as to be superposed on one another. Furthermore, the sheet P onto which the transferred toner image components are held is guided to a fixing nip NF of the fixing device 17 through a transport guide 165.

The toner image components of the colors formed on the photosensitive drums 131 of the respective photosensitive units 13 are sequentially electrostatically transferred (first transfer) onto the intermediate transfer belt 151 by the first transfer rollers 152 to each of which a specified transfer voltage is applied from a power source unit controlled by the system controller 11. Thus, a toner image that is a superposed toner image in which the toner image components of the colors are superposed on one another is formed.

The superposed toner image on the intermediate transfer belt 151 is transported to the second transfer portion TR as the intermediate transfer belt 151 is moved. When the superposed toner image is transported to the second transfer portion TR, the sheet P is supplied from the registration roller pair 24 to the second transfer portion TR at timing adjusted to timing at which the superposed toner image is transported the second transfer portion TR.

A specified transfer voltage is applied to the second transfer roller 162 by the power source unit controlled by the system controller 11. Thus, the superposed toner image on the intermediate transfer belt 151 is collectively transferred onto the sheet P fed from the registration roller pair 24.

The fixing device 17 includes a heating module 171 and a pressure module 172, which are in pressure contact with each other in a pressure contact region so as to define a fixing nip NF (fixing region). The sheet P onto which the toner image components have been collectively transferred in the second transfer portion TR is transported to the fixing device 17 through the transport guide 165 while the toner image components are still unfixed. The toner image components on the sheet P transported to the fixing device 17 are fixed by actions of pressure and heat applied thereto by a pair of the heating module 171 and the pressure module 172.

The sheet P on which a fixed toner image has been formed is guided to a switching gate G1 so as to be output to, by a first output roller pair 173, and received in a sheet output tray TR1 provided in an upper surface of the image forming apparatus 1. Furthermore, in order to invert the sheet P for duplex printing or output the sheet P with an image recording side facing upward, a transport direction of the sheet P is changed toward the transport guide 165 by the switching gate G1.

(2) A Functional Configuration and Operation of the Image Forming Apparatus 1

Figure 3:
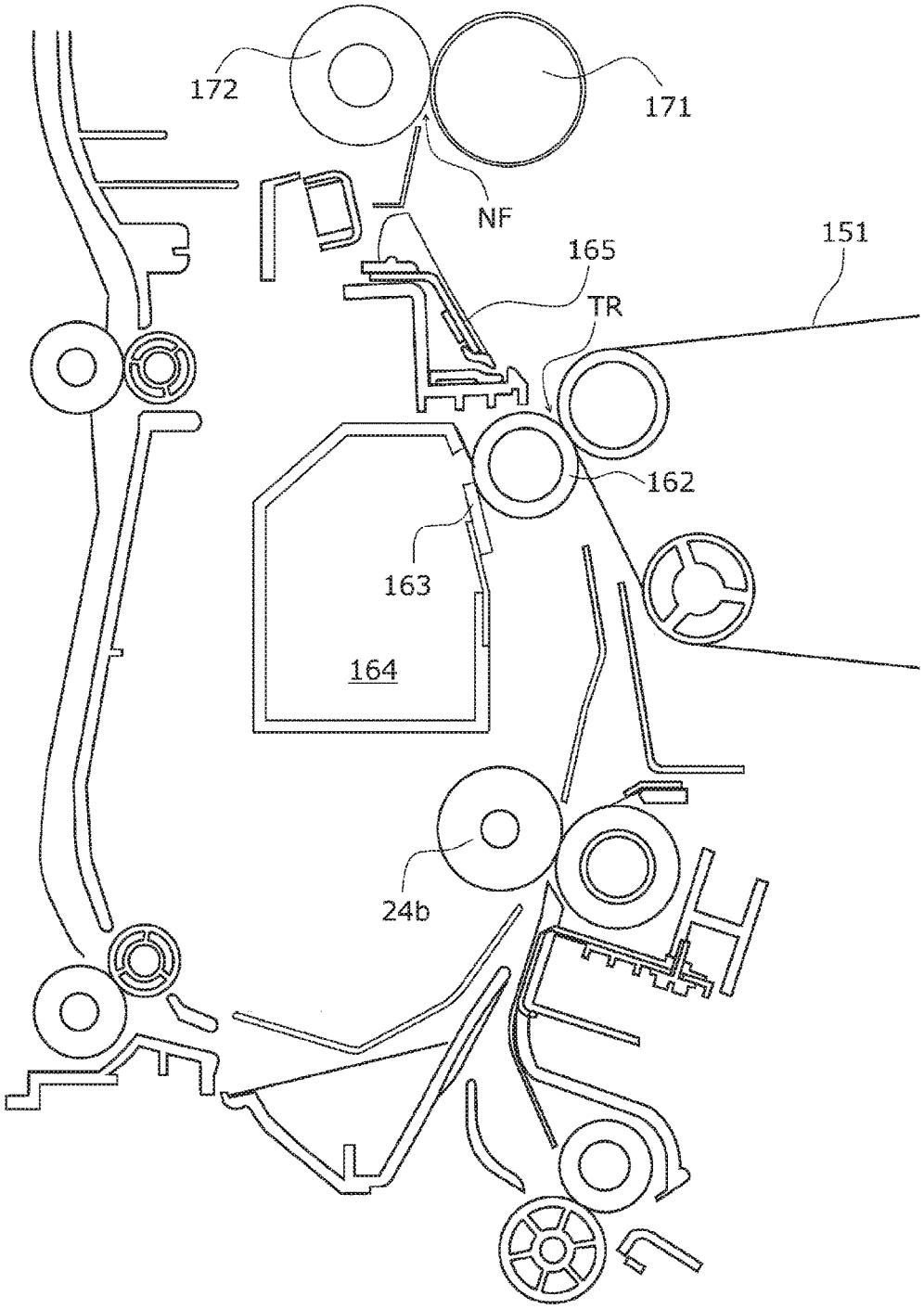
FIG. 3 is a schematic sectional view of a sheet transport device having a second transfer portion.
Figure 4A:
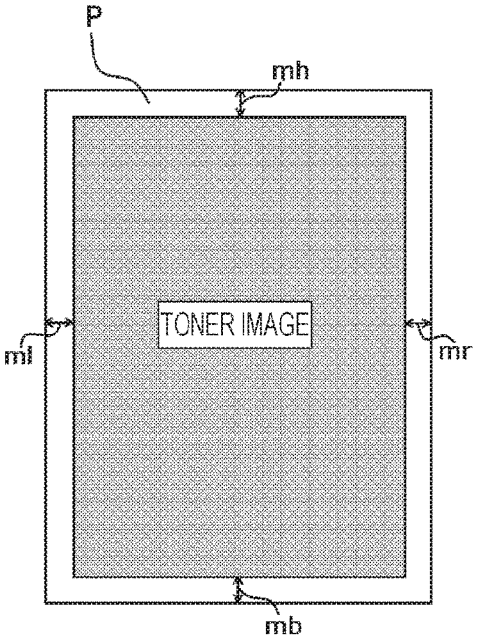
FIG. 4A illustrates bordered printing.
Figure 4B:
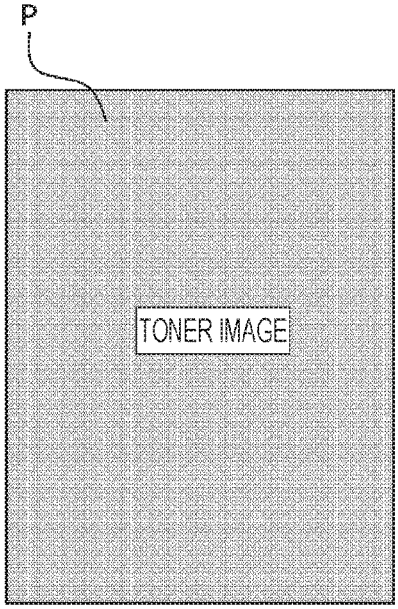
FIG. 4B illustrates borderless printing.
Figure 5A:
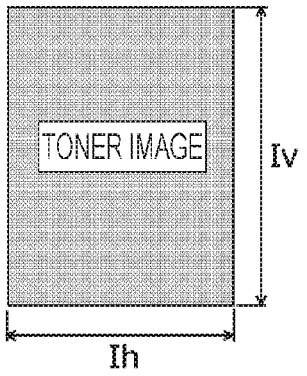
FIGS. 5A to 5C illustrate toner image formation in borderless printing.
Figure 5B:
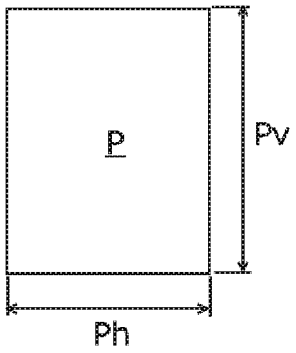
Figure 5C:
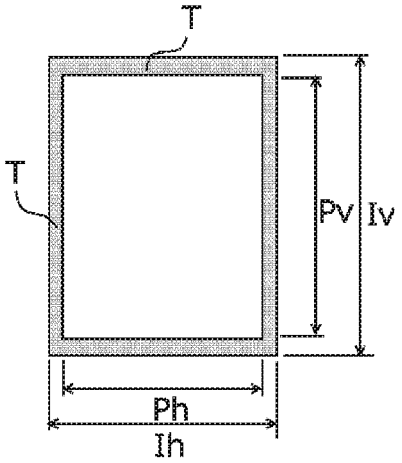

FIG. 2 is a block diagram illustrating an example of a functional configuration of the image forming apparatus 1. FIG. 3 is a schematic sectional view of the sheet transport device having the second transfer portion TR. FIG. 4A illustrates bordered printing, and FIG. 4B illustrates borderless printing. FIGS. 5A to 5C illustrate toner image formation in borderless printing.

(2.1) A Functional Configuration of the System Controller

The image forming apparatus 1 includes the system controller 11 that includes an image output controller 111, a borderless printing determination unit 112, an area coverage calculation unit 113, a toner amount calculation unit 114, a power controller 115, a light exposure controller 116, and a fixing temperature controller 117, thereby controlling operation of the entire image forming apparatus 1 by executing a control program stored in memory.

The image output controller 111 controls exchanging of information with the sheet feed device 20. In addition, the image output controller 111 issues operating control instructions to the following components included in the image forming section 10: that is, the light exposure devices 12, the photosensitive units 13, the developing devices 14, the transfer device 15, the fixing device 17, and so forth.

Furthermore, the image output controller 111 issues operating control instructions to the following controllers included in the system controller 11: that is, the power controller 115, the light exposure controller 116, and the fixing temperature controller 117. That is, the image output controller 111 determines whether or not to supply power to and whether or not to drive the components included in the image forming section 10, that is, the light exposure devices 12, the photosensitive units 13, the developing devices 14, the transfer device 15, the sheet transport device 16, the fixing device 17, and so forth and issues the results of the determination to the controllers of these components.

Furthermore, the image output controller 111 exchanges information with the borderless printing determination unit 112, the area coverage calculation unit 113, and the toner amount calculation unit 114 so as to perform predetermined operating control when the borderless printing is determined.

The borderless printing determination unit 112 determines in accordance with a printing condition set by a printer driver which of the borderless printing and the bordered printing is to be performed.

As schematically illustrated in FIG. 4A, in the bordered printing, a toner image entirely fits in the sheet P with a top margin (mh), a bottom margin (mb), a left margin (ml), and a right margin (mr) set as peripheral margins along the edges of the sheet P.

In contrast, in the borderless printing, as illustrated in FIG. 4B, the toner image extends to end portions of the sheet P, and accordingly, none of the peripheral margins are set. Referring to FIG. 4B, there is no top margin, bottom margin, left margin, or right margin. However, when at least one of the end portions does not have its margin, it is determined to be the borderless printing.

The area coverage calculation unit 113 receives the image data, calculates, for example, the number of pixels (may instead be the number of pixels of an electrostatic latent image) of each of the toner colors, calculates the area coverages of parts of the image to be transferred outside the edges of the sheet P, and outputs a result of the area coverage calculation to the image output controller 111.

The area coverage calculation unit 113 according to the present exemplary embodiment calculates area coverages a1, a2, a3, and a4 outside the edges in accordance with the amounts of image (pixel counts) integrated for the individual edges in the transport direction of the sheet P and a direction perpendicular to the transport direction of the sheet P. The calculated area coverages a1, a2, a3, and a4 are stored in a specified area of a random access memory (RAM) of the image output controller 111.

The toner amount calculation unit 114 serving as an example of a calculator calculates toner amounts A1, A2, A3, and A4 outside the sheet P in accordance with the area coverages a1, a2, a3, and a4 outside the respective edges having been calculated. The toner amount is calculated in accordance with a predetermined weight of toner used for development per pixel. The toner amounts A1, A2, A3, and A4 having been calculated are stored in a specified area of the RAM of the image output controller 111.

(2.2) Borderless Printing

The image forming apparatus 1 has a bordered printing mode and a borderless printing mode. In the bordered printing mode, the image is printed on the sheet P with the margins set along the end portions at the entire periphery of the sheet P. In the borderless printing mode, the image printed on the sheet P extends to the end portions of the sheet P without the margins.

Whether or not this borderless printing is to be performed is determined by the borderless printing determination unit 112 of the system controller 11 that controls the operation of the image forming apparatus 1.

FIG. 5A illustrates the size of the toner image formed on the intermediate transfer belt 151. In FIG. 5A, Iv represents the vertical size and Ih represents the horizontal size. FIG. 5B illustrates the size of the sheet P. In FIG. 5B, the Pv represents the vertical size and Ph represents the horizontal size.

As schematically illustrated in FIG. 5C, the relationships of the sizes of the toner image and the sheet P are set so that Pv<Iv and Ph<Ih. That is, the size of the toner image is slightly larger than the size of the selected sheet P so that the margins are not set in the sheet P even when the sheet P is fed with the position thereof slightly deviated vertically and horizontally.

The toner image having a size of Iv×Ih indicated by a shaded region is formed on the intermediate transfer belt 151. The toner image having a size of Iv×Ih is transported by the intermediate transfer belt 151 toward the second transfer portion TR. Meanwhile, timing control of the sheet P is performed by the registration roller pair 24 so that the sheet P is transported to the second transfer portion TR at timing adjusted to timing at which the toner image enters the second transfer portion TR. Thus, a borderless toner image without the margins at the periphery is formed on the sheet P.

Out of the toner image formed on the intermediate transfer belt 151, the parts of the toner image outside the edges not transferred onto the sheet P in the second transfer portion TR are transferred onto the second transfer roller 162. These parts of the toner image on the second transfer roller 162 are scraped off by a cleaning blade 163 disposed in contact with the second transfer roller 162, and contained in a collection container 164.

The collection container 164 is replaced with a new collection container 164 when the amount of collected toner contained therein has reached a specified total collection amount.

The sheet P on which the borderless toner image without the margins has been formed is fixed onto the sheet P by heat and pressure in the fixing nip NF of the fixing device 17. The sheet P onto which the toner image has been fixed is separated from the heating module 171 side at the exit of the fixing nip NF and output to the sheet output tray TR1 in the upper surface of the image forming apparatus 1 through the first output roller pair 173.

(3) Operation for Borderless Printing

Figure 6:
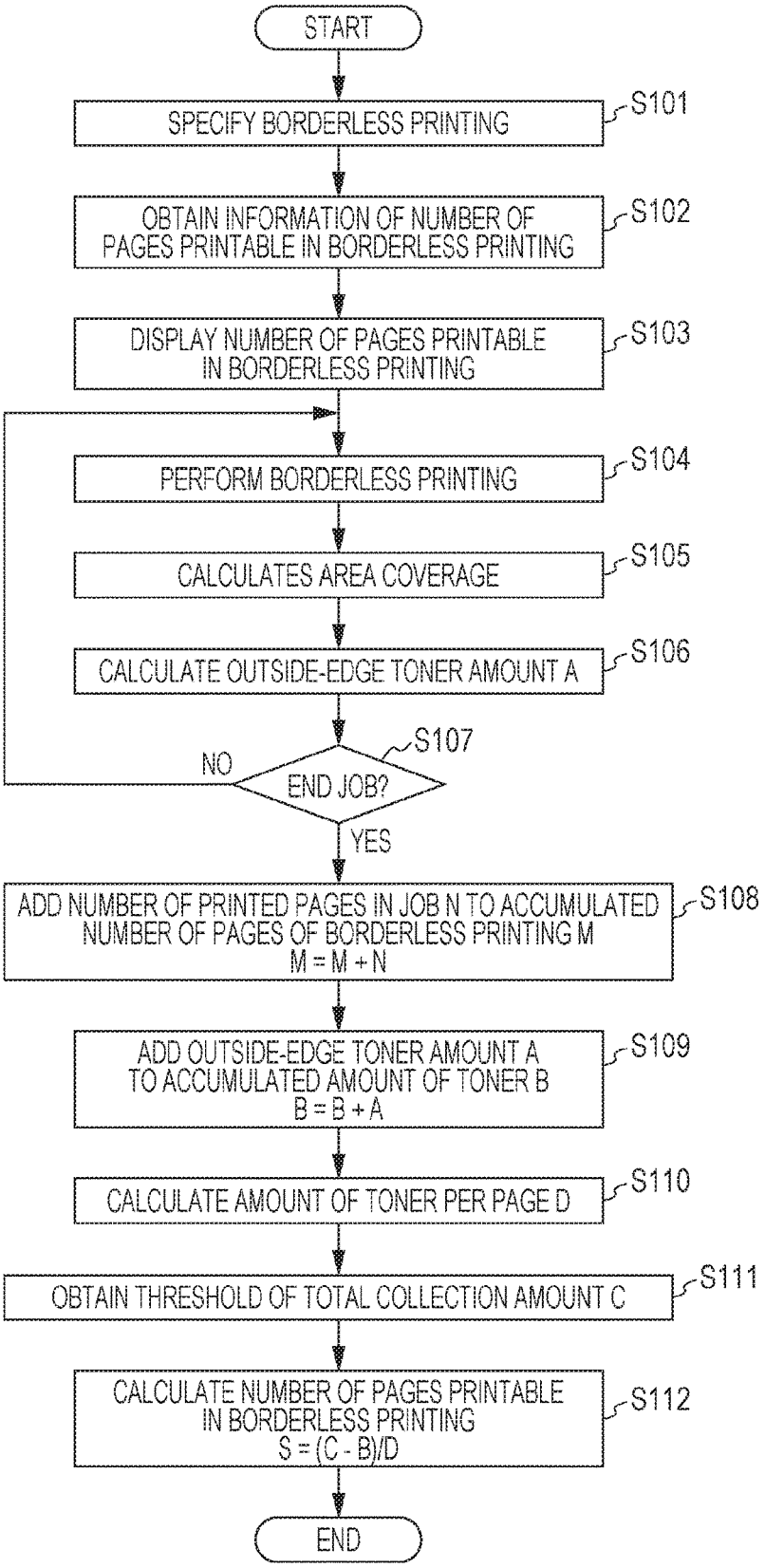
FIG. 6 is a flowchart illustrating a procedure of an operation for calculating the remaining number of pages printable in borderless printing.

FIG. 6 is a flowchart illustrating a procedure of an operation for calculating the remaining number of pages printable in borderless printing. Operating control during the borderless printing is described below with reference to FIG. 6.

With the image forming apparatus 1 according to the present exemplary embodiment, when it is determined that an accepted print job is to be performed in the borderless printing mode, the area coverages of the parts of the image outside the edges of the sheet P are calculated by the area coverage calculation unit 113, and the amounts of toner to be transferred outside the edges of the sheet P are calculated by the toner amount calculation unit 114 in accordance with the calculated area coverages of the parts of the image outside the edges of the sheet P. At the end of the print job, the accumulated amounts of toner in the collection container 164 are estimated so as to calculate a number of pages printable in borderless printing S. The calculated number of pages printable in borderless printing S is displayed in the printer driver or the operating display 30.

When borderless printing is specified in the printer driver (S101), the borderless printing determination unit 112 determines that the accepted print job is to be performed in borderless printing, and the image output controller 111 obtains information of the number of pages printable in borderless printing S stored in a specified area of the RAM (S102).

The obtained number of pages printable in borderless printing S is displayed in the printer driver or the operating display 30 (S103), and the print job which is borderless printing is performed (S104). Then, the area coverage calculation unit 113 calculates the area coverages of the parts of the image outside the edges of the sheet P and stores the results in the specified area of the RAM of the image output controller 111 (S105).

The toner amount calculation unit 114 calculates the toner amounts A1, A2, A3, and A4 of the parts of the image outside the sheet P in accordance with the calculated area coverages a1, a2, a3, and a4 outside the edges and stores the results in the specified area of the RAM of the image output controller 111 (S106).

Then, when the print job ends (YES in S107), a number of printed pages in this print job N is added to an accumulated number of printed pages of borderless printing M having been performed in and before the last print job (M=M+N). The result is stored in a specified area of the RAM of the image output controller 111 (S108).

Furthermore, an outside-edge toner amount A in this print job is added to an accumulated amount of toner B having been used in and before the last print job (B=B+A). The result is stored in a specified area of the RAM of the image output controller 111 (S109).

Next, in accordance with the accumulated number of printed pages of borderless printing M and the accumulated amount of toner B, an amount of toner per page for borderless printing D is calculated (D=B/M; S110). In addition, a threshold of a total collection amount C of collected toner able to be contained in the collection container 164 having been preset in the RAM of the image output controller 111 is obtained (S111).

Then, in accordance with the calculated amount of toner per page for borderless printing D and the threshold of the total collection amount C of collected toner able to be contained in the collection container 164, the number of pages printable in borderless printing S (=(C−B)/D) is calculated (S112), thereby the information of the number of pages printable in borderless printing S is updated.

When it is determined in the next print job that borderless printing is to be performed, the information of the updated number of pages printable in borderless printing S is displayed in the printer driver or the operating display 30 (S103).

Thus, a state in which the collection container 164 is filled up with collected toner contained therein may be detected by calculating the amount of toner transferred outside the sheet P and collected in the second transfer portion TR during borderless printing without use of a waste toner detection sensor.

First Variation

FIGS. 7A to 7E illustrate positional deviation of the sheet relative to the toner image in borderless printing.

With the image forming apparatus 1 according to a first variation, the area coverage calculation unit 113 calculates the number of pixels of part of the toner image outside each of the edges of the sheet P, and the toner amount calculation unit 114 calculates the toner amount of the part of the toner image outside the edge in accordance with a largest number of pixels out of the calculated numbers of pixels.

Figure 7A:
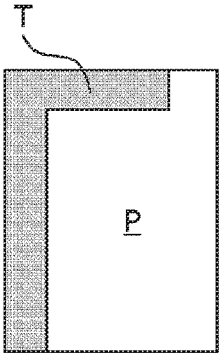
FIGS. 7A to 7E illustrate positional deviation of a sheet relative to the toner image in borderless printing.
Figure 7B:
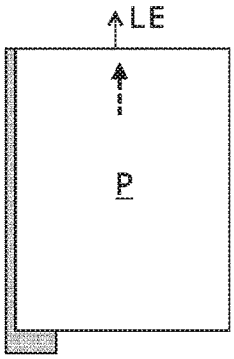
Figure 7C:
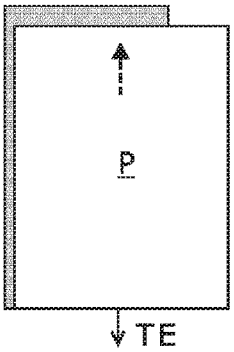
Figure 7D:
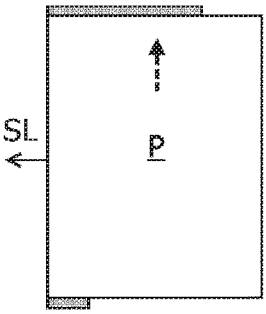
Figure 7E:
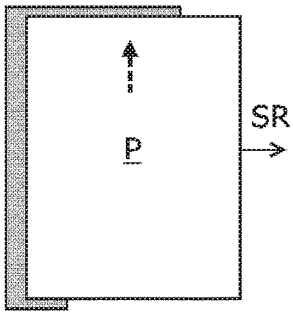

As schematically illustrated in FIGS. 7A to 7E, when a toner image T as an example is formed on the sheet P (see FIG. 7A) and the sheet P is transported to the second transfer portion TR, it is thought that the sheet P is positioned relative to the toner image T as follows: deviated toward a leading edge LE side of the sheet (see FIG. 7B); deviated toward a trailing edge TE side of the sheet (see FIG. 7C); deviated toward a left edge SL side of the sheet (see FIG. 7D); or deviated toward a right edge SR side of the sheet (see FIG. 7E).

In borderless printing exemplified in FIGS. 7A to 7E, out of the number of pixels of the parts of the toner image outside the edges, the number of pixel outside the right side edge of the sheet P is the largest in the case where the sheet P is deviated toward the right side edge SR of the sheet P (see FIG. 7E). The image forming apparatus 1 calculates the number of pixels of the part of the toner image outside each of the edges (LE, TE, SL, and SR) of the sheet P, and the toner amount calculation unit 114 calculates the toner amount of the part of the toner image in accordance with the number of pixels outside the right side edge which is the largest number of pixels out of the calculated numbers of pixels.

Thus, the total collection amount of collected toner contained in the collection container 164 is calculated in accordance with the largest number of pixels out of the calculated numbers of pixels for the edges of the sheet P, and accordingly, an overflow of the toner from the collection container 164 may be prevented.

Second Variation

Figure 8B:
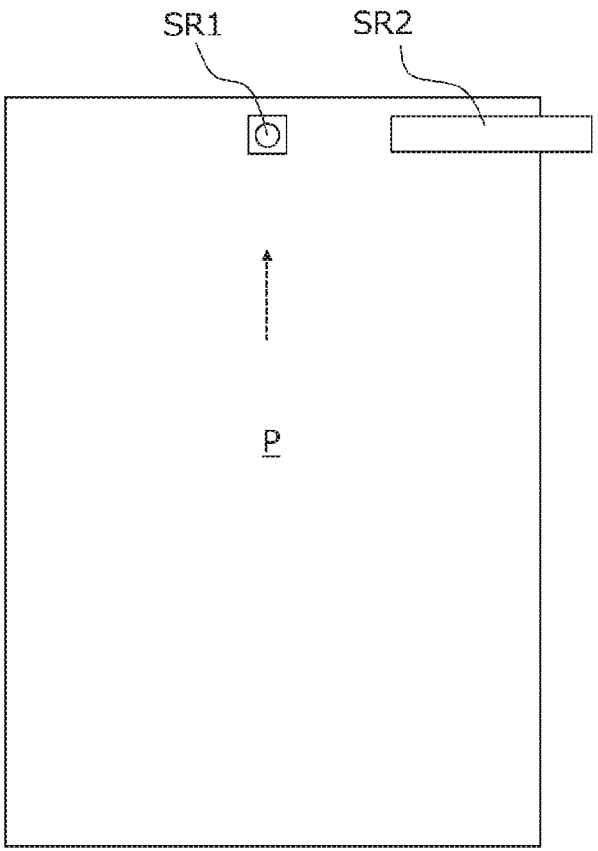
FIG. 8B is a schematic view illustrating arrangement of sheet side-edge detection sensors relative to the sheet.
Figure 8A:
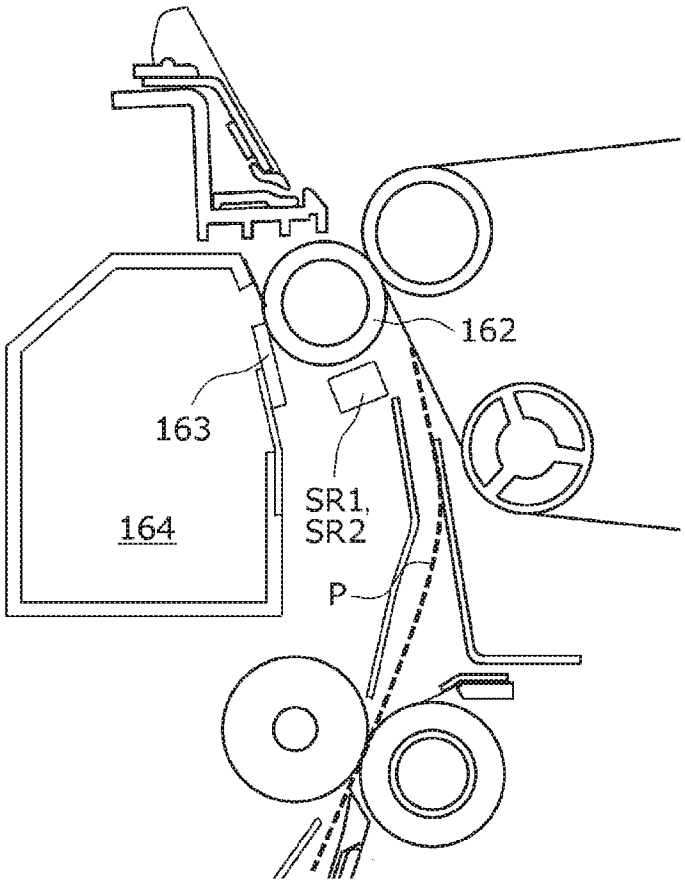
FIG. 8A is a schematic sectional view of the sheet transport device of the image forming apparatus according to a second variation having the second transfer portion.

FIG. 8A is a schematic sectional view of the sheet transport device 16 of the image forming apparatus 1 according to a second variation having the second transfer portion TR. FIG. 8B is a schematic view illustrating arrangement of sheet side-edge detection sensors relative to the sheet P.

The image forming apparatus 1 according to the second variation includes detection sensors SR1 and SR2 serving as detectors that detect at positions upstream of the second transfer portion TR in the transport direction of the sheet P the leading edge and a side edge of the sheet P, respectively. The image forming apparatus 1 corrects the calculated numbers of pixels of parts of the toner image outside the edges of the sheet P in accordance with the amounts of positional deviation of the sheet P relative to a reference position of the sheet P detected by the detection sensors SR1 and SR2.

As the detection sensor SR1 that detects the leading edge of the sheet P, a reflection-type optical sensor that includes a light receiving element and a light emitting element that includes a light emitting diode (LED) or the like is used.

As the detection sensor SR2 that detects the side edge of the sheet P, a contact image sensor (CIS) is used. The CIS includes plural light emitting elements (not illustrated) that include LEDs or the like radiating light to the sheet P and plural light receiving elements (not illustrated) that includes charge-coupled devices (CCDs) or the like receiving the light radiated from the plural light emitting elements and reflected by the sheet P.

As schematically illustrated in FIGS. 7A to 7E, when the toner image T is formed on the sheet P (see FIG. 7A) and the sheet P is transported to the second transfer portion TR, it is thought that the sheet P is positioned relative to the toner image T as follows: deviated toward the leading edge LE side of the sheet (see FIG. 7B); deviated toward the trailing edge TE side of the sheet (see FIG. 7C); deviated toward the left edge SL side of the sheet (see FIG. 7D); or deviated toward the right edge SR side of the sheet (see FIG. 7E).

The area coverage calculation unit 113 calculates the area coverages a1, a2, a3, and a4 outside the edges in accordance with the amounts of image (pixel counts) integrated for the individual edges in the transport direction of the sheet P and the direction perpendicular to the transport direction of the sheet P. The calculated area coverages a1, a2, a3, and a4 are stored in the specified area of the random access memory (RAM) of the image output controller 111.

Then, the area coverages a1, a2, a3, and a4 outside the edges having been calculated are corrected in accordance with the amount of positional deviation relative to the reference position in the transport direction of the sheet P detected by the detection sensor SR1 and the amount of positional deviation relative to the reference position in the direction perpendicular to the transport direction of the sheet P detected by the detection sensor SR2.

Specifically, when a positional deviation toward the sheet leading edge LE side of the sheet P is detected by the detection sensor SR1 (see FIG. 7B), correction is performed so that, in accordance with this detected amount of positional deviation, the area coverage a1 outside the leading edge having been calculated is reduced and the arear coverage a2 outside the trailing edge having been calculated is increased.

Furthermore, when a positional deviation toward the sheet right edge SR side of the sheet P is detected by the detection sensor SR2 (see FIG. 7E), correction is performed so that, in accordance with this detected amount of positional deviation, the area coverage a4 outside the right edge having been calculated is reduced and the arear coverage a3 outside the left edge having been calculated is increased.

Thus, the amount of toner to be collected may be more accurately calculated.

Third Variation

Figure 9B:
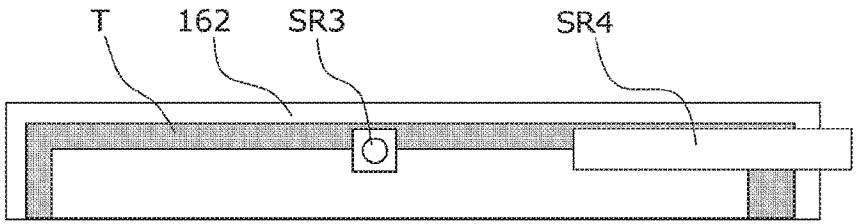
FIG. 9B is a schematic view illustrating arrangement of toner image detection sensors relative to a second transfer roller.
Figure 9A:
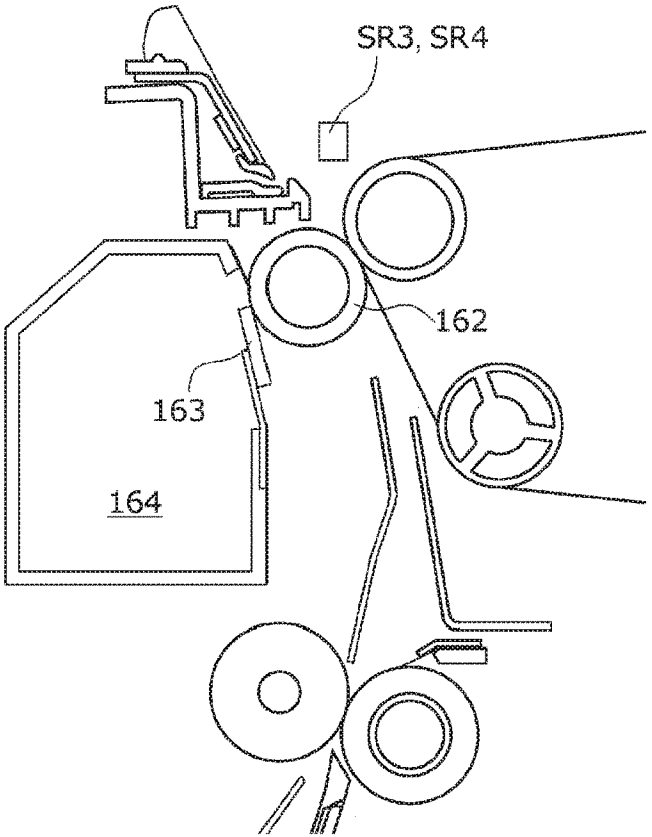
FIG. 9A is a schematic sectional view of the sheet transport device of the image forming apparatus according to a third variation having the second transfer portion.

FIG. 9A is a schematic sectional view of the sheet transport device 16 of the image forming apparatus 1 according to a third variation having the second transfer portion TR. FIG. 9B is a schematic view illustrating arrangement of toner image detection sensors relative to the second transfer roller 162.

The image forming apparatus 1 according to the third variation includes detection sensors SR3 and SR4 serving as detectors that detect the leading edge and the side edge of the toner image T having been transferred onto the second transfer roller 162 in the second transfer portion TR. The image forming apparatus 1 corrects the calculated number of pixels of parts of the toner image outside the edges of the sheet P in accordance with the amounts of positional deviation of the toner image relative to the reference position detected by the detection sensors SR3 and SR4.

Specifically, the leading edge and the trailing edge of the toner image T transferred onto the second transfer roller 162 are detected by the detection sensor SR3, and the positional deviation of the sheet P toward the leading edge LE side is calculated in accordance with a passing time period of the toner image. In accordance with the positional deviation, the area coverages a1 and a2 outside the leading edge and trailing edge of the sheet P having been calculated are corrected.

Furthermore, the widths of the parts of the toner image T transferred onto the second transfer roller 162 are detected by the toner detection sensor SR4. In accordance with the detected widths of the parts of the toner image, the area coverages a4 and a3 outside the right edge and the left edge having been calculated are corrected.

Thus, the parts of the toner image outside the edges of the sheet P transferred onto the second transfer roller 162 are directly detected. Thus, the amount of toner to be collected may be more accurately calculated.

Fourth Variation

Figure 10:
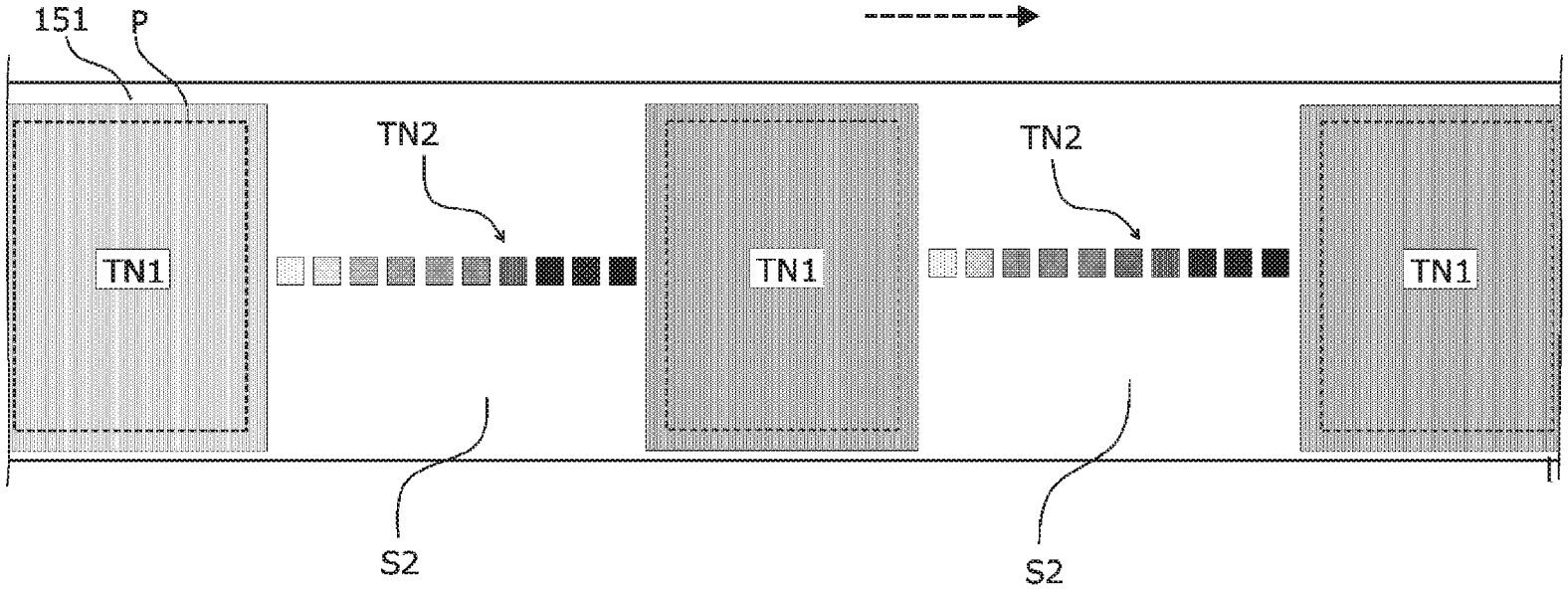
FIG. 10 is a schematic plan view illustrating toner images of image data formed on an intermediate transfer belt during borderless printing and image quality adjustment toner images formed in inter-image regions on the intermediate transfer belt during borderless printing.

FIG. 10 is a schematic plan view illustrating toner images TN1 of image data formed on the intermediate transfer belt 151 during borderless printing and image quality adjustment toner images TN2 formed in inter-image regions S2 on the intermediate transfer belt 151 during borderless printing.

In the image forming apparatus 1, the image quality adjustment toner images TN2 are formed on the intermediate transfer belt 151. A density sensor (not illustrated) reads these image quality adjustment toner images TN2 so as to detect the density of the image quality adjustment toner images TN2. The system controller 11 performs adjustment of the density of the toner images of the colors as an example of correction of an image forming condition in accordance with obtained read results.

The image forming apparatus 1 according to a fourth variation corrects the calculated numbers of pixels of the parts of the toner image outside the edges of the sheet P in accordance with the density of the image quality adjustment toner images TN2.

Specifically, when the density of the image quality adjustment toner images TN2 read by the density sensor is higher than a predetermined specified density, correction is performed so that the area coverages a1, a2, a3, and a4 outside the edges having been calculated are increased. In contrast, when the density of the image quality adjustment toner images TN2 read by the density sensor is lower than the predetermined specified density, correction is performed so that the area coverages a1, a2, a3, and a4 outside the edges having been calculated are reduced.

Thus, the amount of toner to be collected may be more accurately calculated.

Fifth Variation

Figure 11:
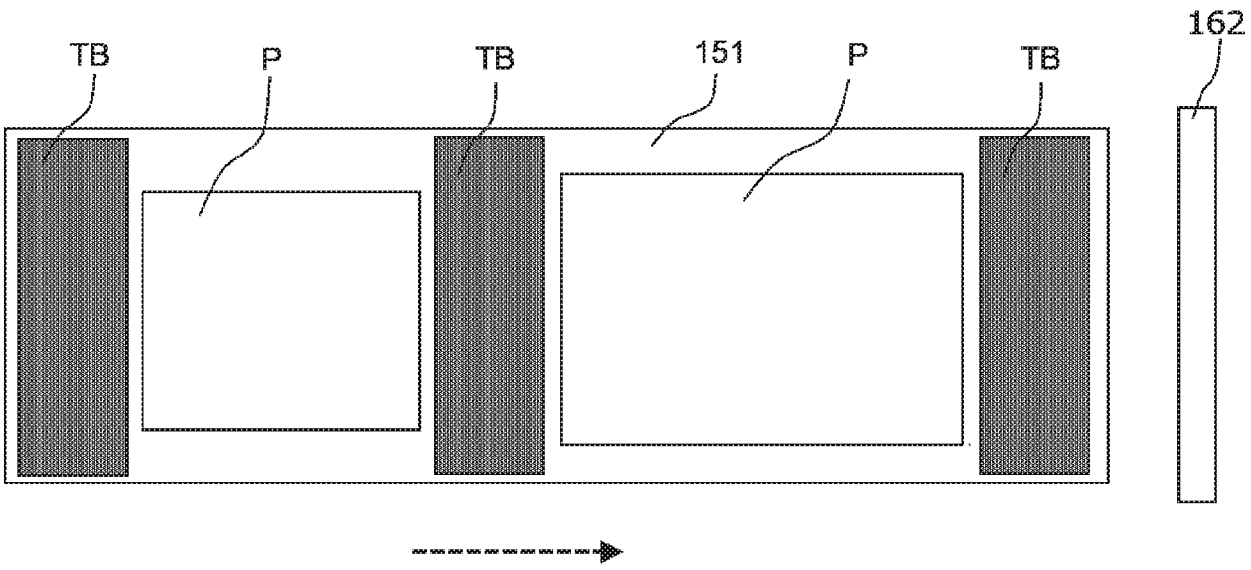
FIG. 11 is a schematic plan view illustrating the relationship between toner images on the intermediate transfer body and the width direction of the second transfer portion when toner bands are formed in inter-image portions.

FIG. 11 is a schematic plan view illustrating the relationship between toner images on the intermediate transfer belt 151 and the width direction of the second transfer portion TR when toner bands TB are formed in inter-image portions IM.

The image forming section 10 also forms toner images not intended to be transferred onto the sheet P. Specifically, the toner bands TB each serving as an example of a band-shaped toner image are formed to protect cleaning blades for the photosensitive drums 131 and the cleaning blade 163 for the second transfer roller 162 and discharge degraded toner from the developing devices 14.

For these purposes, in the image forming apparatus 1, the toner bands TB extending in a direction intersecting the rotational direction of the photosensitive drums 131 (width direction) are formed in non-image regions (inter-image portions IM) positioned between adjacent toner images on the photosensitive drums 131 and transferred onto the second transfer roller 162. Thus, the toner images are supplied as a lubricant between the cleaning blade 163 and the surface of the second transfer roller 162.

The toner of the toner bands TB transferred onto the second transfer roller 162 is scraped off by the cleaning blade 163 and contained in the collection container 164.

The image forming apparatus 1 according to a fifth variation corrects the calculated numbers of pixels of the parts of the toner image outside the edges of the sheet P in accordance with the numbers of pixels of the toner bands TB formed in the non-image regions positioned between the adjacent toner images.

Specifically, when the toner bands TB are formed to protect the cleaning blade 163 of the second transfer roller 162, the area coverage calculation unit 113 calculates the number of pixels of the toner bands TB and adds the calculated results to the area coverages a1, a2, a3, and a4 outside the edge having been calculated. Thus, the amount of toner to be collected may be more accurately calculated.

Second Exemplary Embodiment

Figure 12:
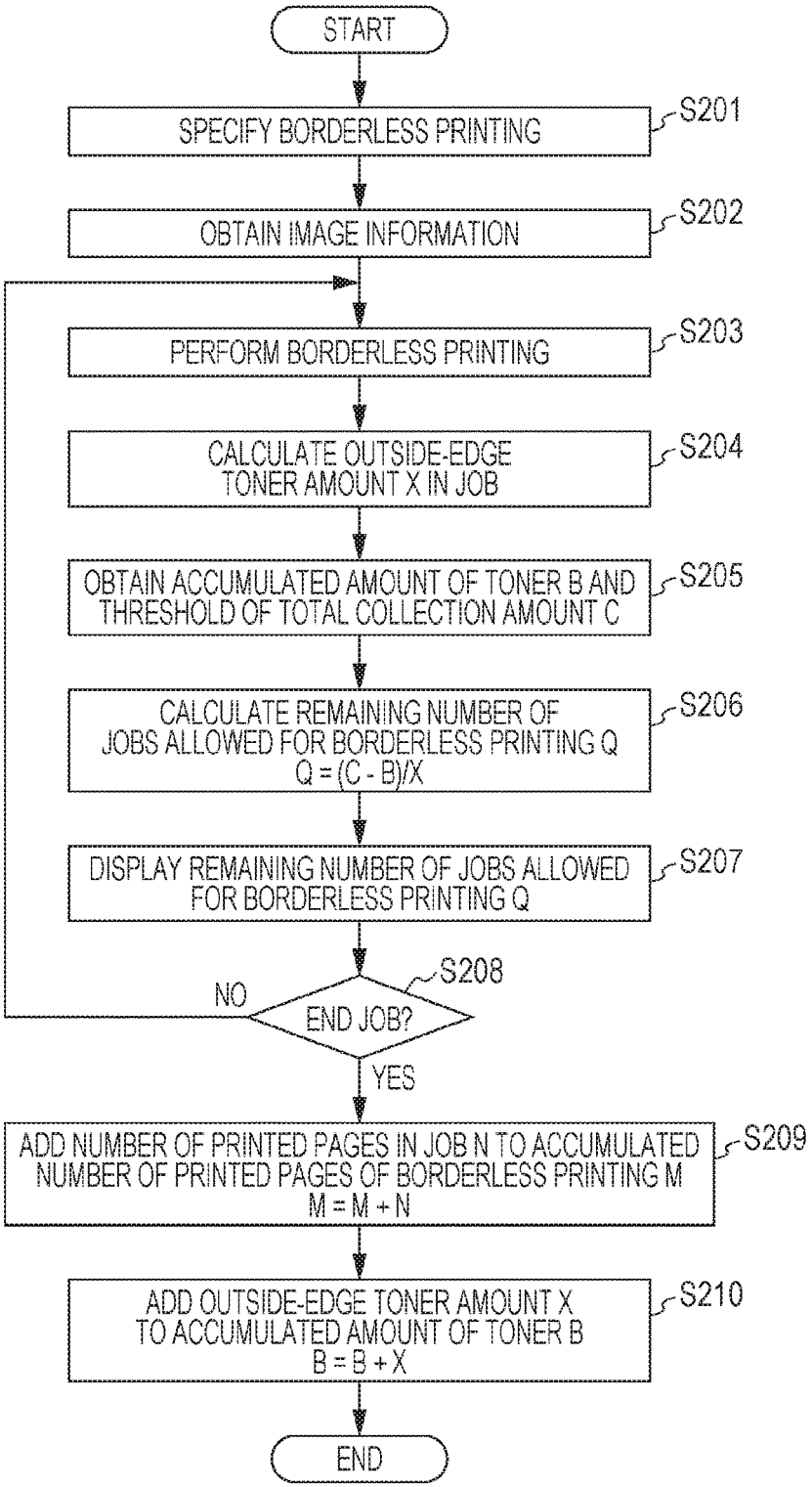
FIG. 12 is a flowchart illustrating a procedure of an operation for displaying the remaining number of pages printable in borderless printing.

FIG. 12 is a flowchart illustrating a procedure of an operation for displaying the remaining number of pages printable in borderless printing.

The operation during the borderless printing with an image forming apparatus 1A is described below with reference to FIG. 12. Elements that are the same as or similar to those of the image forming apparatus 1 according to the first exemplary embodiment are denoted by the same reference numerals and detailed description thereof is omitted.

The image forming apparatus 1A displays the remaining number of jobs allowed for borderless printing in the printer driver by calculating, in accordance with usage information based on a usage state of the apparatus, a time period during which the collection container 164 is able to be used.

When borderless printing is specified in the printer driver (S201), the image output controller 111 obtains image information (S202) and performs a print job which is borderless printing in accordance with the obtained image information (S203).

Then, the area coverage calculation unit 113 calculates the area coverages of the parts of the image outside the edges of the sheet P of this job. The toner amount calculation unit 114 calculates an outside-edge toner amount X which is a total of the toner amounts A1, A2, A3, and A4 outside the sheet P in accordance with the calculated area coverages a1, a2, a3, and a4 outside the edges and stores the results in a specified area of the RAM of the image output controller 111 (S204).

Next, the accumulated amount of toner B associated with borderless printing having been performed and a threshold of the total collection amount C of collected toner able to be contained in the collection container 164 having been preset in the RAM of the image output controller 111 are obtained (S205).

Then, in accordance with the calculated outside-edge toner amount X of this job, the obtained accumulated amount of toner B, and the obtained threshold of the total collection amount C, a remaining number of jobs allowed for borderless printing Q (=(C−B)/X) is calculated (S206) so as to display the number of jobs allowed for borderless printing Q in the printer driver or the operating display 30 (S207).

Then, when the print job ends (YES in S208), the number of printed pages in this print job N is added to the accumulated number of printed pages of borderless printing M having been performed in and before the last print job (M=M+N). The result is stored in a specified area of the RAM of the image output controller 111 (S209).

Furthermore, the outside-edge toner amount X in this print job is added to the accumulated amount of toner B having been used in and before the last print job (B=B+X). The result is stored in a specified area of the RAM of the image output controller 111 (S210). Accordingly, a user may be notified of the remaining number of jobs allowed for borderless printing Q at a time when borderless print job is completed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that transfers to at least one recording medium at least one toner image formed in accordance with image data without margins set along edges of the at least one recording medium;

a container that contains toner collected from the transfer unit; and a calculator that calculates an amount of toner on parts of the at least one toner image that are outside the edges of the at least one recording medium, wherein a time period during which the container is able to be used is calculated in accordance with an accumulated amount of the toner calculated by the calculator.

2. The image forming apparatus according to claim 1, wherein the calculator calculates a number of pixels of each of the parts of the at least one toner image that are outside a corresponding one of the edges of the at least one recording medium and calculates the amount of the toner on the parts of the at least one toner image that are outside the edges in accordance with a largest number of pixels out of the calculated numbers of pixels.

3. The image forming apparatus according to claim 1, further comprising:

detectors that respectively detect a leading edge and a side edge of the at least one recording medium at positions upstream of the transfer unit in a transport direction in which the at least one recording medium is transported, wherein the calculator calculates a number of pixels of each of the parts of the at least one toner image that are outside a corresponding one of the edges of the at least one recording medium, and wherein the calculated numbers of pixels of the parts of the at least one toner image that are outside the edges of the at least one recording medium are corrected in accordance with amounts of positional deviation of the at least one recording medium obtained by the detectors relative to a reference position.

4. The image forming apparatus according to claim 2, further comprising:

detectors that respectively detect a leading edge and a side edge of the at least one recording medium at positions upstream of the transfer unit in a transport direction in which the at least one recording medium is transported, and wherein the calculated numbers of pixels of the parts of the at least one toner image that are outside the edges of the at least one recording medium are corrected in accordance with amounts of positional deviation of the at least one recording medium obtained by the detectors relative to a reference position.

5. The image forming apparatus according to claim 1, further comprising:

detectors that respectively detect a leading edge and a side edge of the at least one toner image transferred to the transfer unit, wherein the calculator calculates a number of pixels of each of the parts of the at least one toner image that are outside a corresponding one of the edges of the at least one recording medium, and wherein the calculated numbers of pixels of the parts of the at least one toner image that are outside the edges of the at least one recording medium are corrected in accordance with amounts of positional deviation of the at least one toner image detected by the detectors relative to a reference position.

6. The image forming apparatus according to claim 2, further comprising:

detectors that respectively detect a leading edge and a side edge of the at least one toner image transferred to the transfer unit, wherein the calculated numbers of pixels of the parts of the at least one toner image that are outside the edges of the at least one recording medium are corrected in accordance with amounts of positional deviation of the at least one toner image detected by the detectors relative to a reference position.

7. The image forming apparatus according to claim 1, wherein the calculator calculates a number of pixels of each of the parts of the at least one toner image that are outside a corresponding one of the edges of the at least one recording medium, and wherein the calculated numbers of pixels of the parts of the at least one toner image that are outside the edges of the at least one recording medium are corrected in accordance with density of an image quality adjustment toner image for correction of an image forming condition under which the at least one toner image is formed.

8. The image forming apparatus according to claim 2, wherein the calculated numbers of pixels of the parts of the at least one toner image that are outside the edges of the at least one recording medium are corrected in accordance with density of an image quality adjustment toner image for correction of an image forming condition under which the at least one toner image is formed.

9. The image forming apparatus according to claim 1, wherein the calculator calculates a number of pixels of each of the parts of the at least one toner image that are outside a corresponding one of the edges of the at least one recording medium, and wherein the calculated numbers of pixels of the parts of the at least one toner image that are outside the edges of the at least one recording medium are corrected in accordance with a number of pixels of a band-shaped toner image which extends in a width direction of the transfer unit and which is formed in a non-image region positioned in a space between the at least one toner image and another toner image adjacent to the at least one toner image.

10. The image forming apparatus according to claim 2, wherein the calculated numbers of pixels of the parts of the at least one toner image that are outside the edges of the at least one recording medium are corrected in accordance with a number of pixels of a band-shaped toner image which extends in a width direction of the transfer unit and which is formed in a non-image region positioned in a space between the at least one toner image and another toner image adjacent to the at least one toner image.

11. The image forming apparatus according to claim 1, further comprising:

a usage state memory that stores usage information based on a usage state of the image forming apparatus;

a usage time calculator that calculates, in accordance with the usage information, a time period during which the container is able to be used; and a notification unit that displays specified content in accordance with the time period calculated by the usage time calculator.

12. The image forming apparatus according to claim 11, wherein the calculator calculates a number of pixels of each of the parts of the at least one toner image that are outside a corresponding one of the edges of the at least one recording medium, wherein the at least one recording medium includes a plurality of recording media, and wherein the usage information based on the usage state of the image forming apparatus includes a total of accumulated numbers of pixels of the parts of the at least one toner image that are outside the edges of the plurality of recording media and a total of an accumulated number of printed pages of borderless printing.

13. The image forming apparatus according to claim 11, wherein the calculator calculates a number of pixels of each of the parts of the at least one toner image that are outside a corresponding one of the edges of the at least one recording medium, wherein the at least one recording medium includes a plurality of recording media, and wherein the usage information based on the usage state of the image forming apparatus includes a total of accumulated numbers of pixels of the parts of the at least one toner image that are outside the edges of the plurality of recording media throughout print jobs and an accumulated amount of the toner collected throughout the print jobs.

* * * * *